US010876734B2

(12) United States Patent
Puoti et al.

(10) Patent No.: US 10,876,734 B2
(45) Date of Patent: Dec. 29, 2020

(54) IGNITION DEVICE FOR A GAS COOKING APPLIANCE

(71) Applicant: ELECTROLUX APPLIANCES AKTIEBOLAG, Stockholm (SE)

(72) Inventors: Eduardo Puoti, Forli (IT); Alessio Marazzato, Forli (IT); Euro Giunchi, Forli (IT); Mauro Angelini, Forli (IT); Fabio Treossi, Forli (IT)

(73) Assignee: Electrolux Appliances Aktiebolag, Stockholm (SE)

( * ) Notice: Subject to any disclaimer, the term of this patent is extended or adjusted under 35 U.S.C. 154(b) by 0 days.

(21) Appl. No.: 16/626,758

(22) PCT Filed: Jul. 16, 2018

(86) PCT No.: PCT/EP2018/069325
§ 371 (c)(1),
(2) Date: Dec. 26, 2019

(87) PCT Pub. No.: WO2019/020426
PCT Pub. Date: Jan. 31, 2019

(65) Prior Publication Data

US 2020/0124289 A1 Apr. 23, 2020

(30) Foreign Application Priority Data

Jul. 28, 2017 (EP) ..... 17183777

(51) Int. Cl.
*F23Q 3/00* (2006.01)
*F24C 3/10* (2006.01)
*H01F 38/12* (2006.01)

(52) U.S. Cl.
CPC ..... *F24C 3/103* (2013.01); *F23Q 3/00* (2013.01); *H01F 38/12* (2013.01)

(58) Field of Classification Search
CPC ..... F24C 3/103
(Continued)

(56) References Cited

U.S. PATENT DOCUMENTS 5,170,768 A * 12/1992 Eileraas ..... F02P 3/02 123/634
5,545,034 A 8/1996 Le Monnier de Gouville
(Continued)

FOREIGN PATENT DOCUMENTS

| | | |
|---|---|---|
| CN | 1521450 | 8/2004 |
| CN | 101814824 | 8/2010 |
| WO | 2006093475 A1 | 9/2006 |

OTHER PUBLICATIONS

International Search Report and Written Opinion in PCT/EP2018/069325 dated Sep. 20, 2018, 10 pages.
(Continued)

*Primary Examiner* — Avinash A Savani
(74) *Attorney, Agent, or Firm* — Pearne & Gordon LLP

(57) ABSTRACT

The present invention relates to an ignition device for a gas cooking appliance, the ignition device comprising at least one ignition device module (10, 10A, 10B) with a primary voltage input terminal (20), a transformer, and at least one secondary voltage output terminal (24, 24A, 24B). The transformer is adapted to transform a primary voltage applied to the primary voltage input terminal into a secondary voltage at the secondary voltage output terminal, and the secondary output terminal is adapted to be connected to a spark electrode. According to the invention the ignition device module (10, 10A, 10B) further comprises a primary voltage output terminal (22).

20 Claims, 4 Drawing Sheets

(58) Field of Classification Search
USPC ..... 431/264
See application file for complete search history.

(56) References Cited

U.S. PATENT DOCUMENTS

| | | | | |
|---|---|---|---|---|
| 2004/0183447 | A1 | 9/2004 | Aleardi | |
| 2009/0098495 | A1* | 4/2009 | Pianezze | F23Q 3/00 431/264 |
| 2010/0033892 | A1 | 2/2010 | Pianezze et al. | |

OTHER PUBLICATIONS

English translation of OA for for Chinese application serial No. 201880045714.0 dated Aug. 24, 2020, 11 pages.

* cited by examiner

IGNITION DEVICE FOR A GAS COOKING APPLIANCE

The present invention relates to an ignition device for a gas cooking appliance.

A prior art ignition device is disclosed in US 2009/0098495 A1. It comprises a primary voltage input terminal, a transformer and a secondary voltage output terminal. The transformer is adapted to transform the primary voltage from an electrical network into a secondary voltage. A secondary voltage output terminal in turn is connected to a spark electrode.

A problem with known ignition devices for gas cooking appliances is the fact that the ignition devices are defined and dimensioned depending on the maximum number of secondary voltage outputs that are needed. Usual numbers of secondary voltage output terminals are two, four, five and six. In the consequence it is only possible to reduce the defined number of secondary voltage outputs by grounding some of the outputs.

It is an object of the present invention to provide for an improved ignition device for a gas cooking appliance which overcomes the above mentioned problems, provides for a more flexible design and reduces the respective production cost.

According to the present invention the ignition device module comprises a primary voltage output terminal.

Since an ignition device according to the present invention has a primary voltage input terminal by means of which it can be connected to a power source and in addition the ignition device module comprises a primary voltage output terminal, the ignition device module in turn can act as a power source for another ignition device module according to the present invention. This is because the primary voltage output terminal can be connected to the primary voltage input terminal of the additional ignition device module so that a plurality of ignition device modules can be connected to each other such as in a parallel connection.

Since the voltage applied to a primary voltage input terminal of the first ignition device module is the same as the voltage at the primary voltage output terminal of this first ignition device module, a plurality of ignition device modules can be connected with each other.

This leads to the advantage that depending on the number of secondary output terminals that are needed, a plurality of ignition device modules can be connected to each other to meet with this need. Therefore, each ignition device module does not need to be over-designed and no or less unused secondary voltage output terminals need to be grounded. As a result, an ignition device according to the present invention comprises a modular design. A minimum number of outputs or secondary output voltage terminals can be designed, and additional modules can be connected to the first ignition device module in case more secondary voltage output terminals are needed in order to obtain the required number of secondary voltage output terminals.

This modularization of the ignition device simplifies the component management, reduces the power per ignition device module and leads to a cost reduction due to the increased production volume per ignition device module. The reduction of the power per ignition device modules also increases the lifetime of these components.

In a preferred embodiment, the ignition device comprises a plurality of ignition device modules. The primary voltage input terminal of a first ignition device module is adapted to be connected to a power supply, and the primary voltage input terminal of a subsequent ignition device module is connected to the primary voltage output terminal of the preceding ignition device module.

Further preferably, the ignition device modules are connected in parallel by connecting the primary voltage output terminal of each preceding ignition device module to a primary voltage input terminal of a subsequent ignition device module.

The ignition device can be (mechanically and electrically) plugged together whereby each primary voltage input terminal of a subsequent ignition device module is connected to the primary voltage output terminal of the preceding ignition device module.

Each ignition device module can comprise more than one, preferably two secondary voltage output terminals. Not all ignition device modules need to have the same number of secondary voltage output terminals, which increases the flexibility of the modular concept. But preferably all have one or all have two secondary voltage output terminals, which is a good compromise between simplification and adaptability.

In an ignition device comprising a plurality of ignition device modules, the ignition device modules preferably are consecutively arranged along an axis, wherein the primary voltage input terminals and the primary voltage output terminals define mating male and female connectors, the male connectors being aligned along the axis and adapted to be received by the female connectors. This allows a very simple stacking of the ignition device modules. A mechanical and an electrical interconnection between the modulus is thereby reached in a simultaneous manner.

Further preferably the male connectors are arranged on a forefront of a body of the ignition device modules and the female connectors on a backside of the body or vice versa. A backside of an ignition device module can thus be plugged onto the forefront of the following ignition device module.

The secondary voltage output terminal(s) preferably is (are) arranged on lateral sides of the assigned ignition device module. This leads to the benefit that the secondary voltage output terminals do not interfere the stacking of the modules and remain accessible in a row of stacked modules.

Each ignition device module preferably comprises mating mechanical connection means which are adapted to provide for a form-fit connection between two consecutive ignition device modules. This improves the retention force between the modules.

For example, mechanical connection means may be provided which enable an interlocking of subsequent ignition device modules. Said mechanical connection means comprise one or more snap hooks adapted to provide a detachable securing of subsequent ignition device modules against each other. Thereby an undesired loosing of the electrical coupling between the ignition device modules can be avoided.

According to embodiments, a housing or body of the ignition device module comprises connection means for connecting the ignition device module with a surrounding mechanical structure. Said connection means may comprise a protrusion or pin which provides a securing of the ignition device module at an opening of the mechanical structure. Alternatively, the housing or body of the ignition device module may comprise a hole including a thread for providing a screw connection between the housing of the ignition device module and the surrounding mechanical structure. Thereby, a technically simple fixation of the ignition device module is possible.

All ignition device modules of an ignition device can be identical. On the other hand at least two ignition device modules can have different numbers of secondary voltage output terminals, whereas the means for interconnecting the modules (electrically and mechanically) remain the same. As an example a ignition device module having one secondary voltage output terminal can be combined with a module having two secondary voltage output terminals.

Each ignition device module can comprises a printed circuit board (PCB) carrying the transformer.

Further preferably, a primary voltage applied to the primary voltage input terminal of an ignition device module is fed through the ignition device module to the primary voltage output terminal such that the voltage at the primary voltage input terminal is the same as at the primary voltage output terminal.

The primary voltage preferably is an AC voltage of 100-240 V at 50-60 Hz, further preferably 230V at 50 Hz.

According to a further aspect, the present disclosure refers to a gas appliance comprising an ignition device according to anyone of the preceding embodiments.

According to yet a further aspect, the present disclosure refers to a method for assembling a gas appliance. The method comprises the steps of:

providing two or more ignition device modules;

connecting a primary voltage input terminal of a first ignition device module to a power supply; and connecting a primary voltage input terminal of a second ignition device module to a primary voltage output terminal of said first ignition device module.

The present invention will be described in further detail with reference to the accompanying drawings in which.

Figure 1:
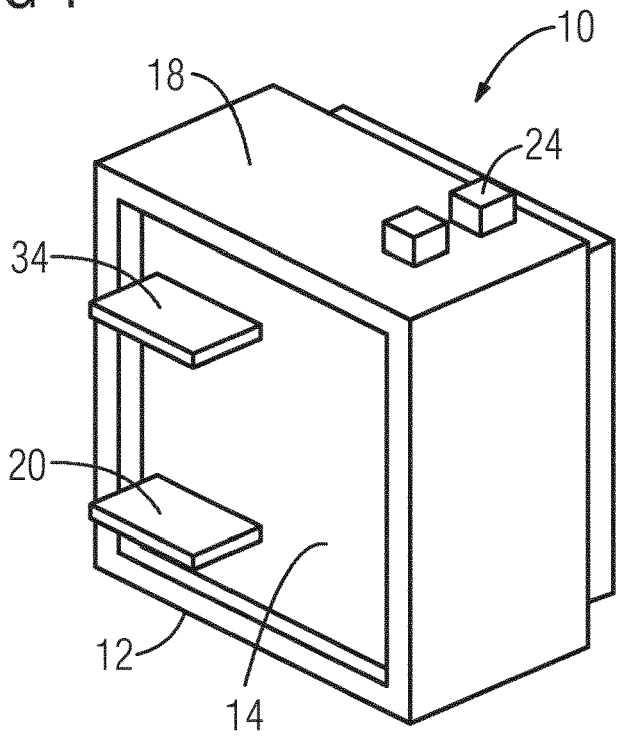
FIG. 1 illustrates a schematic perspective view onto an ignition device module according to the present invention.

FIG. 1 shows an ignition device module 10 according to the present invention in a perspective view onto a forefront 14 of a body 12 of the ignition device module 10. A primary voltage input terminal 20 is provided on the forefront 14 and is defined by two male connectors 34. On the lateral side 18 of the body 12 two connectors of a secondary voltage output terminal 24 are provided. Within the body 12 means are provided to transform a primary voltage which is applied to the primary voltage input terminal 20 into a secondary voltage at the secondary voltage output terminal 24. The means can comprise a transformer (not shown) with a primary and a secondary winding used to increase the primary voltage to a higher value of the secondary voltage at the secondary voltage output terminal 24. Secondary voltage output terminal 24 can be connected to a spark generating means. The secondary voltage output terminal 24 (connected to the secondary winding of the transformer) can e.g. be connected to a spark electrode which is placed at a distance according to a spark gap from a grounded conduction element such that a spark is generated when the secondary voltage between the spark electrode and the grounded conducting element is sufficient to overcome the spark gap. In some embodiments a burner of the gas cooking appliance may be grounded and serve as the grounded element. The transformer inside the ignition device module 10 serves to increase the primary voltage applied to the primary voltage input terminal 20 to a secondary voltage applied to the secondary output voltage output terminal 24 of 5.000-10.000 Volt.

Figure 2:
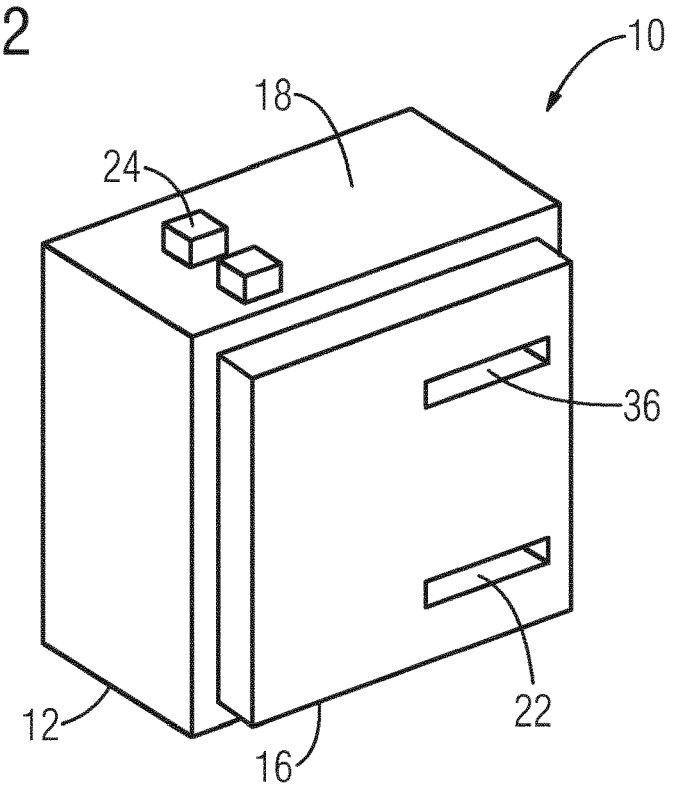
FIG. 2 shows a view onto the backside of the ignition device module of FIG. 1.

FIG. 2 shows a view onto a backside 16 of the ignition device module 10 of FIG. 1. On this backside 16 of the body 12 a primary voltage output terminal 22 is defined by two female connectors 36. Both female connectors 36 are arranged at positions and have a cross-section so as to mate with the male connectors 34 on the forefront 14 of the ignition device module 10. The voltage at the primary voltage output terminal 22 is the same as applied to the primary voltage input terminal 20. In other words each main connector 34 is in direct electrical connection with a respective female connector 36 as it will be described in further detail with reference to FIG. 3.

Figure 3:
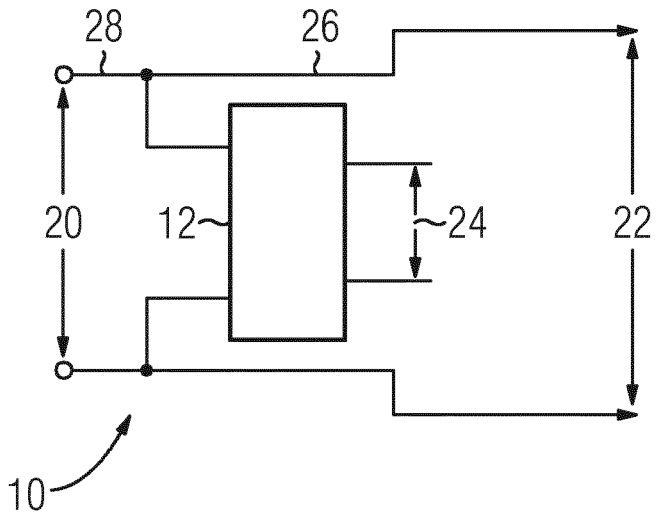
FIG. 3 shows a wiring pattern of an ignition device module according to the present invention.
Figure 4:
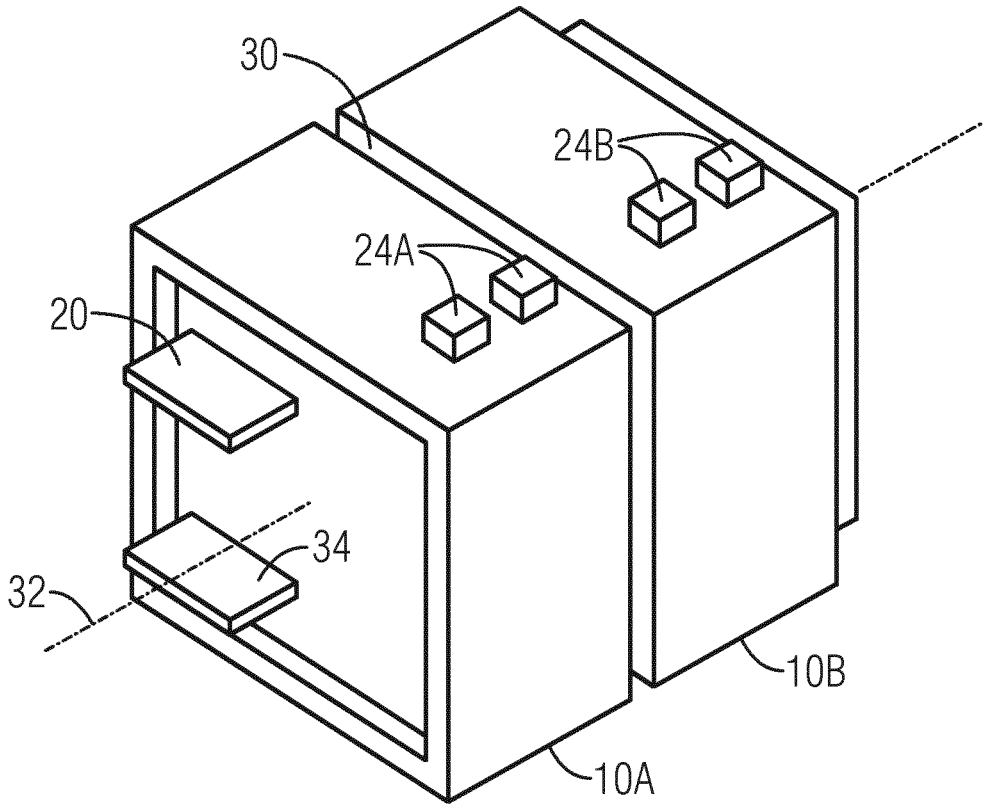
FIG. 4 shows two ignition device modules which are connected in order to define an ignition device.

FIG. 3 shows a wiring pattern of an ignition device module 10 according to the present invention, such as the ignition device module 10 of FIGS. 1, 2 and 4. On the left side of the ignition device module 10 the primary voltage input terminal 20 is illustrated. On the hand side of FIG. 3 the primary voltage output terminal 22 is shown. As can be seen there is a direct connection between the primary voltage input terminal 22 and the primary voltage output terminal 22 by means of feedthrough line 26. From feedthrough line 26 a feed-in line 28 branches and is connected to a transformer 38 located inside body 12 of the ignition device module 10 of FIG. 1. Transformer 38 transforms the primary voltage of primary voltage input terminal 20 into the secondary voltage and applies the secondary voltage to secondary voltage output terminal 24. Feed-in line 28 is connected to a primary winding of transformer 38 and secondary voltage output terminal 24 to a secondary winding of transformer 38.

FIG. 4 demonstrates the modularity of the ignition device module according to the present invention. Two ignition device modules 10A and 10B are shown arranged and plugged together or stacked along an axis 32. Since the not shown main connectors of ignition device module 24B are mating with the female connectors 36 of ignition device module 10A, both ignition device modules 10A and 10B are not only mechanically plugged together (e.g. by a snap fit connection between their respective bodies 12) but there is also an electrical connection between male connectors 34 of ignition device module 10B and a female connector 36 of ignition device module 10A. In the perspective view of FIG. 4 the respective male and female connectors between both ignition device modules cannot be seen but both ignition device modules 24A and 24B comprise identical male connectors 34 and female connectors as shown e.g. in FIGS. 1 and 2. Since all male connectors 34 and female connectors 36 are mating with each other (position, cross-section, length and depth respectively) it follows that additional ignition device modules can simply be plugged onto the first ignition device module 10A or behind the second ignition device module 10B.

It is to be noted that the last ignition device module in the shown embodiment ignition device 10B is covered by an end cap 40 so that the open female connectors 36 of the last ignition device module 10B are covered for security reasons.

The combined ignition device comprising the two ignition device modules 24A and 24B can be connected to a source of electrical power by means of the primary voltage input terminal 20 of ignition device module 10A.

In the embodiment of FIG. 4 (and also FIGS. 1 and 2) each ignition device module 10A, 10B comprises one single secondary voltage output terminal 24A, 24B including two connectors. In alternative embodiments at least one of the ignition device modules 10A, 10B can comprise more than one secondary voltage output terminal 24 such as two secondary voltage output terminals. Using only ignition device modules with two (four or six) secondary voltage output terminals leads in combination to an even total number of secondary voltage output terminals wherein each secondary voltage output terminal can be connected to one burner.

However, also ignition device modules having different number of secondary voltage output terminals 24 can be combined provided that respective male and female connectors 34 are still mating. Therefore any desired number of secondary voltage output terminals 24 can be reached by plugging a respective number of respective types (defined by the number of secondary voltage output terminals 24) together. This leads to a modularity of the present inventive concept.

Figure 5:
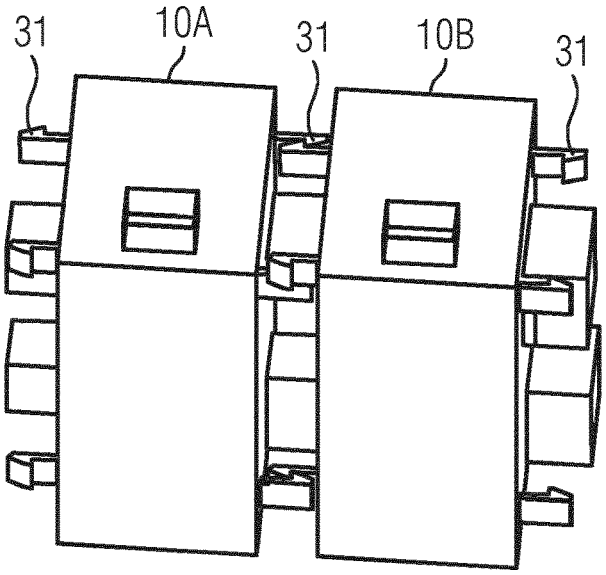
FIG. 5 shows two ignition device modules which are mechanically connected based on multiple pairs of snap hooks.

FIG. 5 shows a pair of ignition device modules 10A, 10B which are—besides the linkage due to the connectors 34, 36—mechanically coupled by mechanical connection means. In the present embodiment, said mechanical connection means comprise multiple pairs of snap hooks 31. In order to provide said mechanical connection, one or more snap hooks 31 are provided at each ignition device module 10A, 10B. When coupling the ignition device modules 10A, 10B, an electrical connection between male and female connectors 34, 36 is provided. In addition, corresponding snap hooks 31, which are arranged next to each other, are interlocked. More in detail, corresponding snap hooks 31 are aligned such that hook areas of said snap hooks 31 are interlinked. Thereby, the ignition device modules 10A, 10B are mechanically linked such that an undesired release of connection is prevented.

Also other mechanical connection means may be possible, for example, snap connectors included in a housing portion surrounding the male and/or female connectors 34, 36, pin connectors or any other connection means providing a detachable or non-detachable mechanical coupling.

Figure 6:
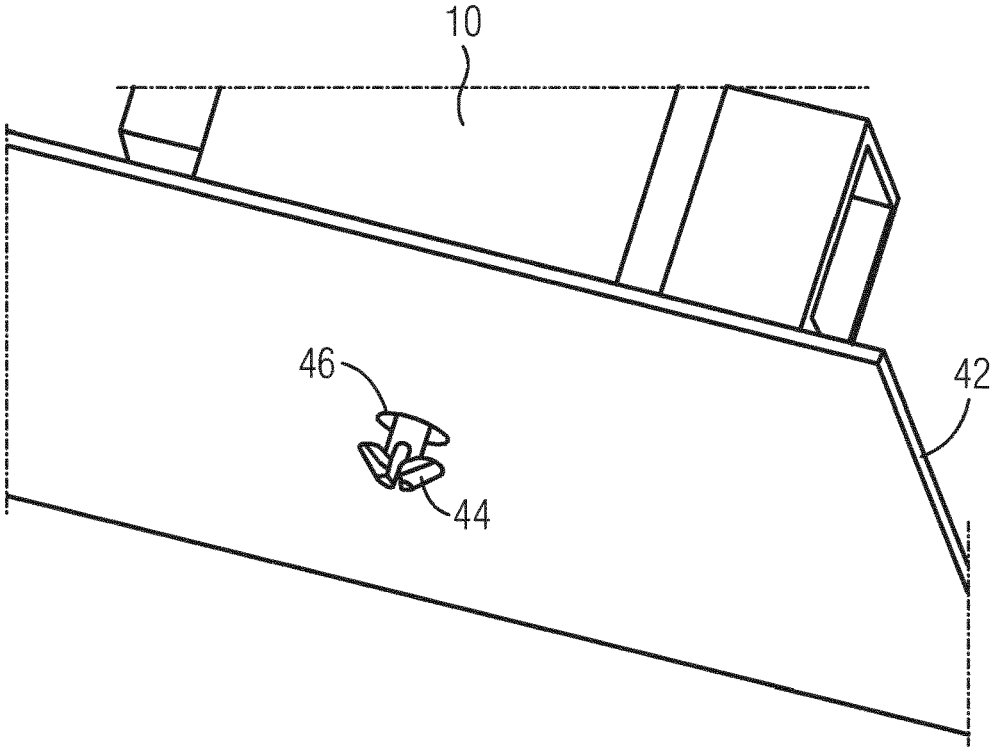
FIG. 6 shows an ignition device module which is mechanically connected with a surrounding mechanical structure of a gas appliance based on a pin with multiple radial protrusions.
Figure 7:
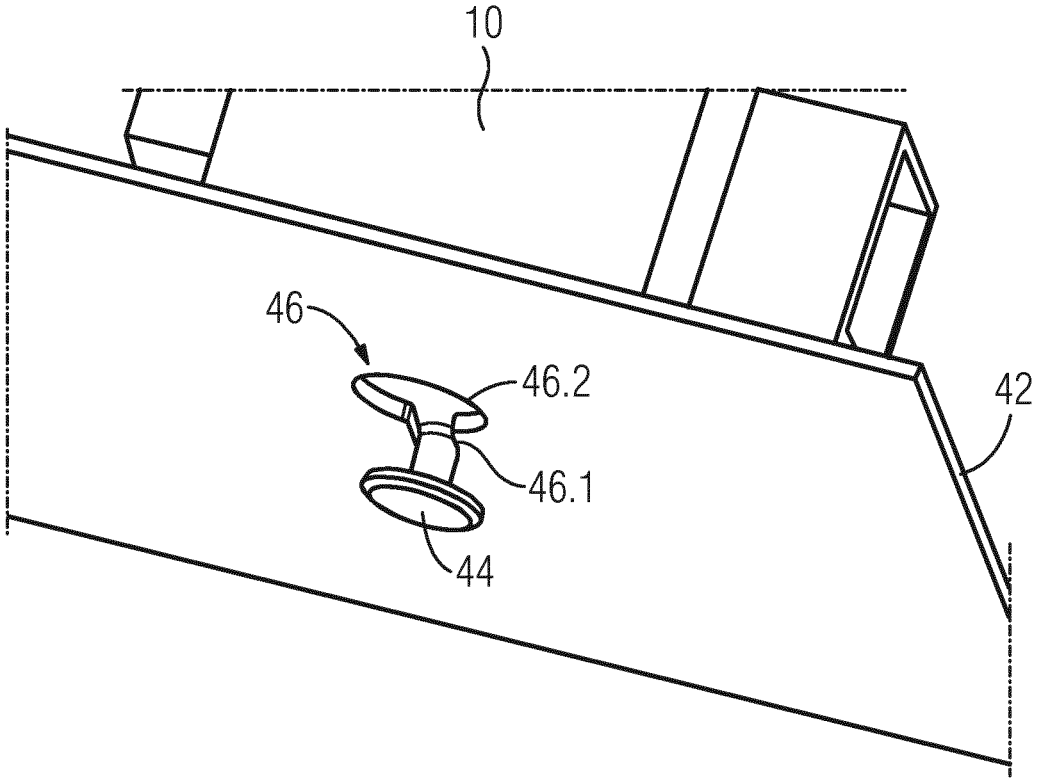
FIG. 7 shows an ignition device module which is mechanically connected with a surrounding mechanical structure of a gas appliance based on a mushroom-shaped pin.

FIGS. 6 and 7 show different possibilities of coupling an ignition device module 10, 10A, 10B with a surrounding mechanical structure 42. Said mechanical structure 42 may be, for example, a piece of metal which supports said ignition device module 10, 10A, 10B.

The ignition device module 10 according to FIG. 6 comprises a housing with a bottom portion. From said bottom portion, a pin-like connection mean 44 protrudes based on which said ignition device module 10 is coupled with said mechanical structure 42. Said connection mean 44 may be configured to be inserted in an opening 46 provided in said mechanical structure 42. Preferably, said connection mean 44 may be adapted to penetrate the mechanical structure 42.

The connection mean 44 according to FIG. 6 comprise a pin portion and locking means adapted to prevent an undesired loosing of the ignition device module 10 from said mechanical structure 42. Said locking means may comprise one or more lock portions radially protruding from said pin portion. Said lock portions are dimensioned such that the said lock portions engage behind the edge of the opening 46.

FIG. 7 shows a further embodiment of connection means 44 for securing the ignition device module 10 at the mechanical structure 42. In contrary to the embodiment of FIG. 6, the ignition device module 10 comprises connection means 44 in form of a mushroom-shaped pin. The mushroom-shaped pin is provided at a bottom portion of the ignition device module 10 and protrudes from said bottom portion. Said mushroom-shaped pin is adapted to interact with a keyhole-shaped opening 46 provided in the mechanical structure 42. Said keyhole-shaped opening 46 comprises a first opening portion 46.1 with first opening dimensions and a second opening portion 46.2 with second opening dimensions. Said second opening portion 46.2 may be a slot-like opening portion adjoining immediately at said first opening portion 46.1 and may radially protrude from said first opening portion 46.1.

Said first opening dimensions may be grater than said second opening dimensions. More in detail, said first opening dimensions may be chosen such that said mushroom-shaped pin can be inserted in said opening 46. After inserting, the mushroom-shaped pin can be moved into said second opening portion 46.2 thereby obtaining an interlocking of the mushroom-shaped pin at the mechanical structure 42.

Furthermore, also other possibilities of securing the ignition device module 10 at the mechanical structure 42 may be possible, e.g. securing the ignition device module 10 at the mechanical structure 42 based on a screw connection. For example, the housing of the ignition device module 10 may comprise an opening with a thread for receiving a free end of a screw based on which said securing of the ignition device module 10 at the mechanical structure 42 is obtained.

LIST OF REFERENCE SIGNS

10 ignition device module
10A ignition device module
10C ignition device module
12 body
14 forefront
16 backside
18 lateral side
20 primary voltage input terminal
22 primary voltage output terminal
24 secondary voltage output terminal
26 feed through line
28 feed in line
30 connection
31 snap hook
32 axis
34 male connectors
36 female connectors
38 transformer
40 end cap
42 mechanical structure
44 connection mean
46 opening
46.1 first opening portion
46.2 second opening portion

The invention claimed is:

1. An ignition device for a gas cooking appliance, the ignition device comprising at least one ignition device module with a primary voltage input terminal, a transformer, and at least one secondary voltage output terminal, wherein the transformer is adapted to transform a primary voltage applied to the primary voltage input terminal into a secondary voltage at the secondary voltage output terminal, and the secondary voltage output terminal is adapted to be connected to a spark electrode, wherein the ignition device module further comprises a primary voltage output terminal, and wherein the primary voltage is an AC voltage of 100-240 V at 50-60 Hz.

2. The ignition device of claim 1, wherein the ignition device comprises a plurality of said ignition device modules, wherein the primary voltage input terminal of a first said ignition device module is adapted to be connected to a power supply, and the primary voltage input terminal of a subsequent said ignition device module is connected to the primary voltage output terminal of the first ignition device module.

3. The ignition device according to claim 1, wherein the ignition device comprises a plurality of said ignition device modules, wherein the primary voltage input terminal of a first said ignition device module is adapted to be connected to a power supply, and wherein the plurality of ignition device modules are connected in parallel by connecting the primary voltage output terminal of each preceding one of said ignition device modules with a primary voltage input terminal of a subsequent one of said ignition device modules.

4. The ignition device according to claim 1, wherein the ignition device comprises a plurality of said ignition device modules, wherein the ignition device modules are plugged together, and each primary voltage input terminal of a subsequent said ignition device module is connected to the primary voltage output terminal of a preceding said ignition device module.

5. The ignition device according to claim 1, wherein the ignition device module or each said ignition device module(s) comprise(s) a plurality, preferably two secondary voltage output terminals.

6. The ignition device according to claim 1, wherein the ignition device comprises a plurality of said ignition device modules and wherein the primary voltage input terminal of a subsequent said ignition device module is plugged into a primary voltage output terminal of a preceding said ignition device module.

7. The ignition device of claim 6, wherein the ignition device modules are consecutively arranged along an axis, wherein the primary voltage input terminals and the primary voltage output terminals thereof define mating male and female connectors, the male connectors being aligned along the axis and adapted to be received by the female connectors.

8. The ignition device of claim 7, wherein the male connectors are arranged on a forefront of a body of the ignition device modules and the female connectors on a backside of the body or vice versa.

9. The ignition device of claim 7, wherein each secondary voltage output terminal is arranged on a lateral side of the assigned ignition device module.

10. The ignition device according to claim 2, wherein each said ignition device module comprises mating mechanical connection means which are adapted to provide for a form-fit connection between two consecutive ones of said ignition device modules.

11. The ignition device of claim 10, wherein said mechanical connection means comprise one or more snap hooks, wherein said snap hooks are adapted to provide a detachable interlocking of subsequent ignition device modules.

12. An ignition device for a gas cooking appliance, the ignition device comprising at least one ignition device module with a primary voltage input terminal, a transformer, and at least one secondary voltage output terminal, wherein the transformer is adapted to transform a primary voltage applied to the primary voltage input terminal into a secondary voltage at the secondary voltage output terminal, and the secondary voltage output terminal is adapted to be connected to a spark electrode, wherein the ignition device module further comprises a primary voltage output terminal, and wherein a housing of the ignition device module comprises connection means for connecting the ignition device module with a surrounding mechanical structure.

13. The ignition device according to claim 12, wherein said connection means comprise a protrusion configured to be inserted into a corresponding opening of the surrounding mechanical structure or a hole including a thread for providing a screw connection between the housing of the ignition device module and the surrounding mechanical structure.

14. The ignition device according to claim 2, wherein all said ignition device modules are identical.

15. The ignition device according to claim 2, wherein at least two of said ignition device modules have different numbers of said secondary voltage output terminals.

16. The ignition device according to claim 1, wherein each said ignition device module comprises a printed circuit board (PCB) carrying the transformer.

17. The ignition device according to claim 1, wherein a primary voltage applied to the primary voltage input terminal is fed through the at least one ignition device module to the primary voltage output terminal such that the voltage at the primary voltage input terminal is the same as at the primary voltage output terminal.

18. A gas appliance comprising the ignition device according to claim 1.

19. A method for assembling a gas appliance, the method comprising the steps of:

providing two or more ignition device modules;

connecting a primary voltage input terminal of a first said ignition device module to a power supply supplying an AC voltage of 100-240 V at 50-60 Hz; and connecting a primary voltage input terminal of a second said ignition device module to a primary voltage output terminal of the first said ignition device module.

20. The method of claim 19, wherein:

the first said ignition device module has a transformer and a secondary voltage output terminal, wherein the transformer is adapted to transform a primary voltage applied to the primary voltage input terminal of the first said ignition device module into a secondary voltage at the secondary voltage output terminal, and wherein the primary voltage is the same voltage supplied by the power supply.

* * * * *